United States Patent [19]

Sheppard, Jr

[11] 4,089,426

[45] * May 16, 1978

[54] APPARATUS FOR ALIGNING PRE-ASSEMBLED PARTS

[76] Inventor: Walter R. Sheppard, Jr, Rte. 6, 969 Iris Dr., Conyers, Ga. 30207

[ * ] Notice: The portion of the term of this patent subsequent to Mar. 16, 1993, has been disclaimed.

[21] Appl. No.: 325,018

[22] Filed: Jan. 19, 1973

[51] Int. Cl.[2] ..... B66F 7/12

[52] U.S. Cl. ..... 214/1 H; 29/428; 238/13; 254/85

[58] Field of Search ..... 214/1 H, 1 D; 238/13; 254/84, 85; 52/79; 29/428

[56] References Cited

U.S. PATENT DOCUMENTS

| | | | |
|---|---|---|---|
| 178,390 | 6/1876 | Taylor et al. | 254/85 |
| 1,737,250 | 11/1929 | Kress | 238/13 |
| 3,089,680 | 5/1963 | Deve | 254/85 |
| 3,362,351 | 1/1968 | Robertson | 254/84 X |
| 3,679,177 | 7/1972 | Scholz | 214/1 H X |
| 3,734,465 | 5/1973 | Patchen et al. | 254/84 |

FOREIGN PATENT DOCUMENTS

| | | | |
|---|---|---|---|
| 238,694 | 8/1925 | United Kingdom | 254/85 |

*Primary Examiner*—Frank E. Werner
*Attorney, Agent, or Firm*—Jones, Thomas & Askew

[57] ABSTRACT

A method and apparatus to assemble two structures wherein a first structure is substantially permanently placed and a second structure is to be moved to be contiguous with the first structure. Traversing assemblies include a movable platform supported on bearings, and traversing means to move the platforms. The structure is supported on three jacks, the jacks resting on the platforms of the traversing units, and the traversing means are operated to move the second structure until it is contiguous with the first structure.

4 Claims, 8 Drawing Figures

APPARATUS FOR ALIGNING PRE-ASSEMBLED PARTS

BACKGROUND OF THE INVENTION

This invention relates to a method and apparatus for moving together and aligning large preassembled structures, such as the halves of "double wide" mobile homes.

It has become common for "double wide" mobile homes and prefabricated houses to be designed so that two or more large structures are constructed separately at a central construction site and are transported to a home site and put together to form a single, double-width house. When the separate structures are delivered to the home site, one of the structures is placed upon a permanent foundation and the second structure is initially rolled close to and in approximate alignment with the first structure. When the two structures have been placed adjacent each other, the second structure is placed on runners and is forced along the runners toward the first structure until the two structures are in abutting relationship and, hopefully, are in proper alignment.

The prior art method of movement and alignment of the structures has been unsatisfactory. One prior art method of assembly comprises urging the movable structure along runners by means of jacks that are placed at an incline to bear against the structure. Since the structure will normally weigh several tons, there is the danger that the structure will be damaged by the localized pressure of the jacks. Each end of the movable structure is urged by jacks alternately so that the moving structure is sidled up against the first structure, and this sidling motion is difficult to control sufficiently to assure that the two structures will come to rest in proper alignment. If the runners are placed at an incline so the movable structure slides down the incline the structure may slide uncontrolled down the incline and damage both structures when the moving structure engages the stationary structure. In addition, if the two structures are brought together and found not to be longitudinally aligned, it is difficult to move the structures longitudinally with respect to each other. Any longitudinal misalignment of the halves of the structure usually causes the internal door frames, floor surfaces, ceiling and walls of each half to be out of alignment with the other half.

SUMMARY OF THE INVENTION

The present invention overcomes the above-mentioned and other difficulties with the prior art method by providing a method in which the movable half of a double wide mobile home or similar structure is placed in aligned abutting relationship with its mating stationary structure. The movable structure is first rolled to a position beside the stationary counterpart, is elevated on traversable jack assemblies or dollies that are oriented to move the structure in the desired direction, and the traversable jack assemblies are then manipulated to move the movable structure toward the first structure until the two structures are contiguous. Permanent support elements are then placed beneath the movable structure and the traversable jack assemblies are removed.

The traversable jack assemblies of the present invention are suited to the method in that each includes a jack and a traversing assembly, and the traversing assembly includes a jack support platform which is removably supported by a support tray, and bearings between the platform and the tray carry the weight. A vertically distendable jack is supported on the jack support platform. The elements of each of the jack assemblies are separable, and the assembly can be put into place under the structure one part at a time, which is desirable because of the limited space usually present beneath the structure and the weight of the parts of the assembly. Further, the system includes master traversing jack assemblies and slave traversing jack assemblies so that the motion of the structure is controlled without manipulation of all of the traversing assemblies.

These and other features and advantages of the present invention will become apparent from consideration of the following specification when taken in conjunction with the accompanying drawings.

DESCRIPTION OF A PREFERRED EMBODIMENT

Figure 1:
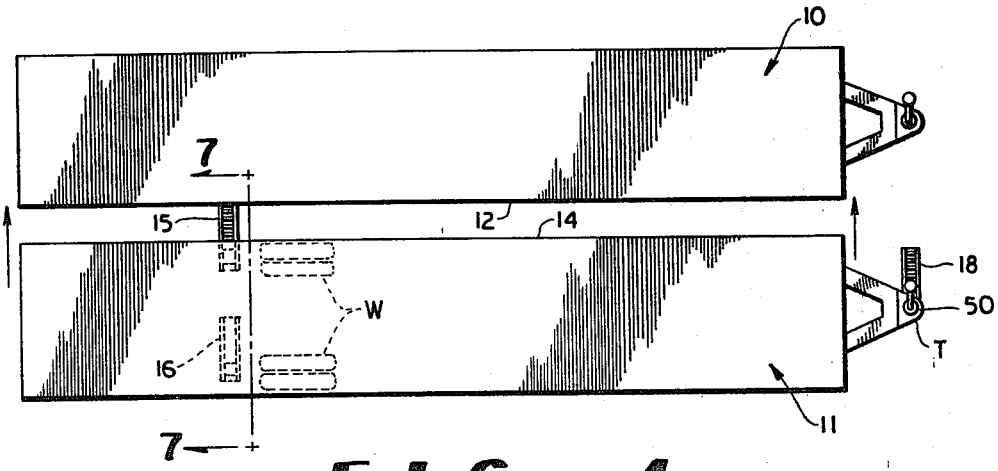
FIG. 1 is a top plan view of two structures to be brought together utilizing the method and apparatus of the present invention.

Referring now more particularly to the drawing, FIG. 1 shows a first stationary half 10 of a structure that has been set into place on the desired home site. The second half 11 of the structure is moved on its wheels W by means of a towing vehicle to a position alongside the structure 10, and the dollies or traversable jack assemblies 15, 16 and 18 of the present invention are placed beneath and support the structure 11 so the structure can be moved to have the sides 12 and 14 of the halves of the structure in aligned abutment.

Figure 2:
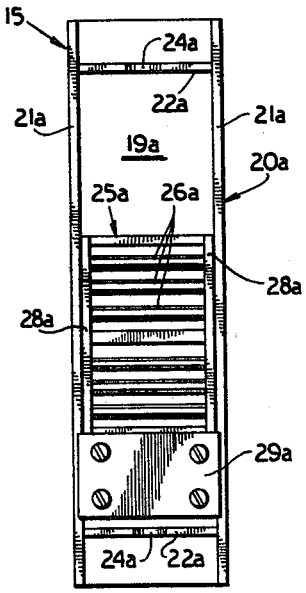
FIGS. 2, 3, and 4 are top plan views of the three varieties of traversing assemblies made in accordance with the present invention and suited for use in the method of the present invention.

The traversing assembly 15 shown in FIG. 2 is a slave unit, and includes a pan member **20*a* which functions as a stationary support means and includes a rectangular bottom wall 19*a*, opposed upright side walls 21*a*, and opposed upright end walls 22*a* that are set inwardly of the ends of the bottom wall 19. The end walls 22*a* define central slots 24*a*** in their upper edges.

Within the pan member **20*a* there is a ladder bearing 25*a* which comprises a plurality of needle bearings 26*a* spaced apart by side rails 28*a*. A jack support platform 29*a* is received within the pan member 20*a* and rests on the bearing 25*a*. Thus, the platform 29*a* can be moved along the pan member 20*a*, the bearing 25*a* carrying the weight and allowing the platform 29*a*** to be moved easily, even while carrying a relatively heavy weight.

Figure 3:
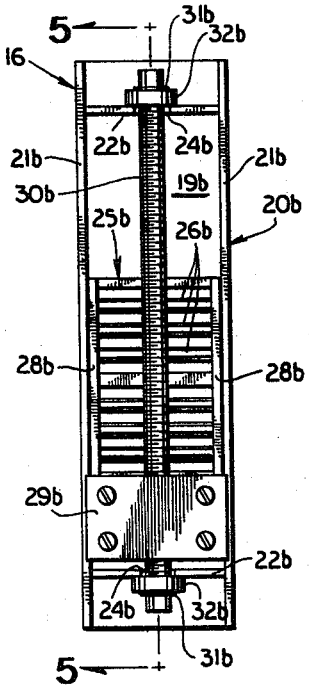

The traversing assembly 16 is shown in FIG. 3 of the drawings and has all the parts above described in connection with the traversing assembly 15; therefore, all these parts have the same number with a *b* suffix. In addition, the traversing assembly 16 includes a travel screw **30*b* that is received within the slots 24*b*** in the end walls 22*b*. The travel screw 30*b* is provided with flanges 31*b* fixed to the screw to provide a stop for bearings 32*b*.

A travelling nut 41 (FIG. 5) is sandwiched within the platform 29*b* in a non-rotatable relationship and threadedly engages the travel screw 30*b* so that the travelling nut and travel screw function as a means for moving the jack support platform along the length of pan member 20*b* upon rotation of the travel screw. The traversing assembly 16 is therefore a master unit.

The traversing assembly 18 shown in FIG. 4 of the drawings includes all the parts previously discussed in connection with the traversing unit 16; therefore, these parts carry the same numbers with a *c* suffix. In addition, the traversing unit includes a cup 34*c* fixed to the platform 29*c*. Traversing assembly 18 includes a travel screw 30*c*, and therefore is also a master unit.

Figure 5:
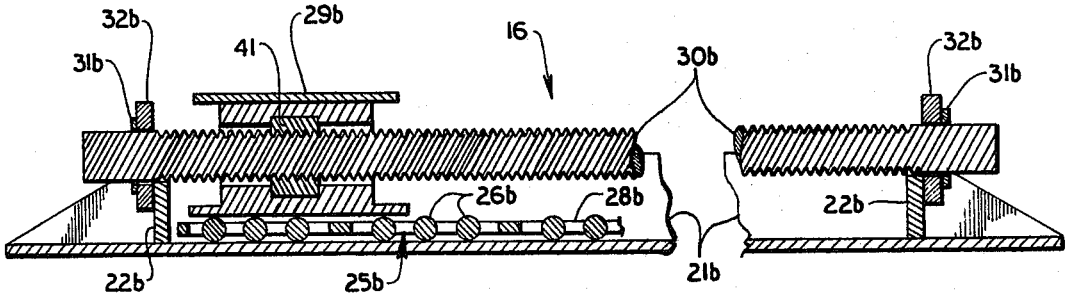
FIG. 5 is a longitudinal cross-sectional view taken substantially along the line 5—5 of FIG. 3.
Figure 6:
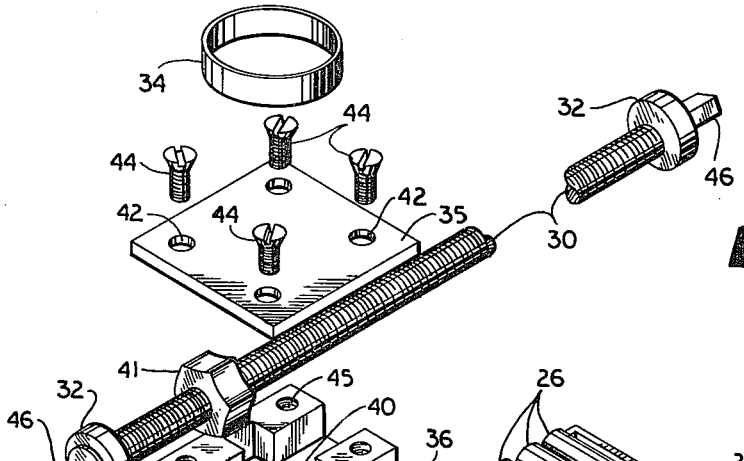
FIG. 6 is an exploded perspective view of the traversing assembly shown in FIG. 4.
Figure 8:
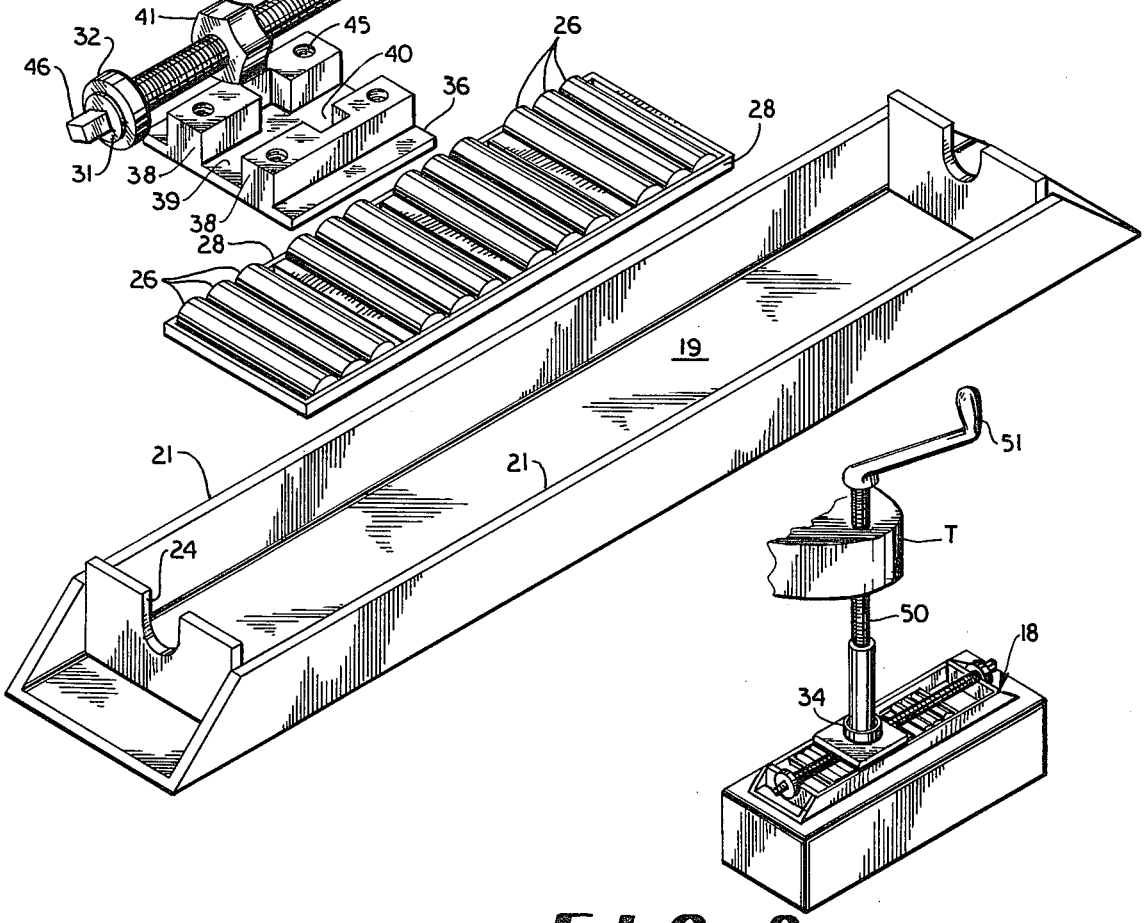

For greater detail of the construction of the traversing assemblies 15, 16 and 18, attention is directed to FIGS. 5 and 6 of the drawings where traversing assembly 18 is illustrated in greater detail. Since these two figures are intended to describe all three units generally, the same numerals are used as before to designate the same parts, but with no suffix.

The pan member 20 is formed of sheet material, the side walls 21 being bent to an upright attitude from the material of the pan 20. The end walls 22 are then fixed in place, as by welding or the like to the bottom wall 19 and opposed side walls 21. The side walls 21 are tapered down toward the bottom of the pan beyond the end walls 22, but this can be varied as desired, and this arrangement provides additional stability of the unit when the platform 29 is at one extreme end of the pan 20.

The ladder bearing 25 is preferably of a width only slightly less than the interior dimension of the pan 20 to allow the bearing 25 to roll freely within the pan 20. The height of the bearing side rails 28 should be less than the diameter of the needle bearings 26, so that the side rails 28 maintain the desired spacing of the needle bearings 26 but the side rails 28 do not interfere with the free rolling of the needle bearings 26. Though no precise spacing of the needle bearings 26 along the side rails 28 is required, it will be understood by those skilled in the art that the needle bearings 26 should be sufficiently close together to give good stability to the platform 29 in all positions along the pan 20.

Jack support platform 29 is made up of a pair of plates including upper plate 35 and lower plate 36. The lower plate 36 is substantially the same width as the ladder bearing 25 since this plate rests on and moves over the bearing. A pair of spacers 38 is attached to the lower plate 36, the spacers 38 defining a passage 39 therebetween; and, the passage 39 includes a recess 40 to receive the travelling nut 41.

Figure 4:
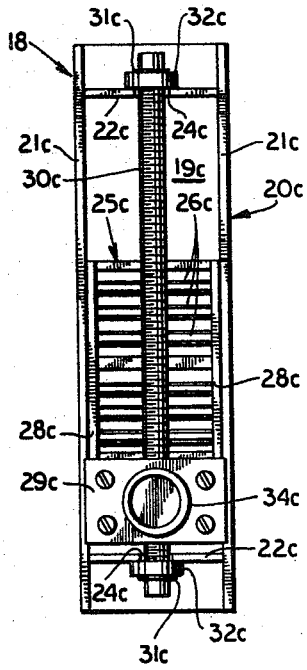

The upper plate 35 of the platform 29 is substantially the same width as the outside dimension of the pan member 20, as is best shown in FIGS. 2, 3 and 4. The plate 35 has a plurality of holes 42 to receive screws 44, the holes 42 being aligned with complementary, threaded holes 45 in the spacers 38.

If the traversing assembly is to be used as the master traversing assembly 18, the upper plate 35 will have the cup 34 fixed thereto. The cup 34 may take the form of an annulus welded or otherwise fixed to the plate 35.

The travel screw 30 is simply a threaded shaft having ends 46 shaped to receive a wrench or other tool by which the screw 30 can be rotated. Inwardly of the ends 46, flanges 31 are fixed to the shaft; and, inwardly of the flanges 31, bearings 32 surround the shaft. The bearings 32 are preferably sealed ball bearings.

It will now be seen that the traversing assemblies are simple and easy to maintain. The ladder bearing 25 is placed into the pan 20, and the platform 29 is placed on the bearing 25. If the unit is to be used as a master unit, the upper plate 35 is removed and the travel nut 41 and travel screw 30 (FIG. 6) are inserted, the upper plate is reconnected to the lower plate 36 before placing the platform 29 on the bearing 25. Since the elements of the traversing assemblies are separable and are easy to disassemble, it is easy to clean the units to prevent the buildup of dirt, gravel and other extraneous matter that may interfere with the proper operation of the unit.

OPERATION

The method will be described in connection with assembling the halves of a "double wide" mobile home, although it will be readily understood that the same method with only a few variations can be used for assembling sections of virtually any structure, and if the total structure comprises more than two parts, the method would be used to align the subsequent structures.

Figure 7:
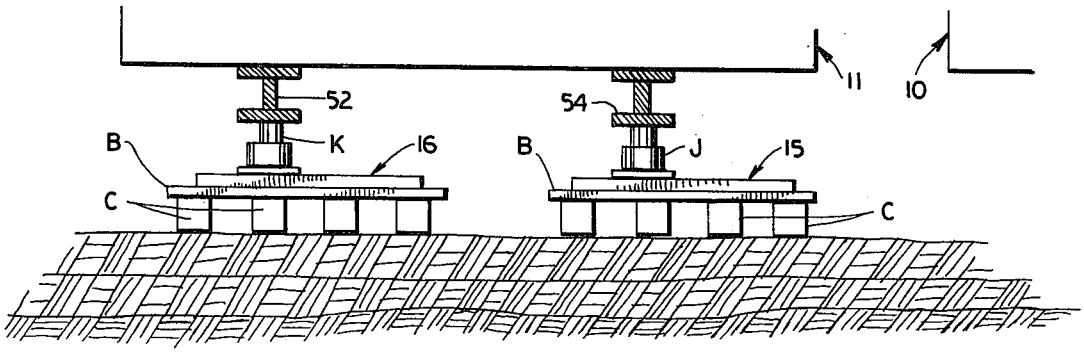
FIG. 7 is an enlarged cross-sectional view taken substantially along the line 7—7 in FIG. 1; and, FIG. 8 is a perspective view showing the use of the traversing assembly of FIG. 4.

The conventional mobile home is provided with wheels W and with a trailer yoke or tongue T (FIG. 1). The tongue T conventionally has a vertical jack screw 50 threadedly received by the tongue and provided with a crank 51 so that the jack screw 50 can act, with the wheels W, to support the trailer in a substantially horizontal stationary position. Also, there is conventionally a pair of I-beams 52 and 54 (FIG. 7) running the full length of the trailer as part of the main support for the trailer.

First, the movable half 11 of the double wide mobile home is towed to the site by a tractor or the like, and the tractor (not shown) rolls the section 11 as close as practical and in side-by-side alignment with the counterpart section 10.

With the section 11 thus supported, a temporary horizontal support structure such as beam B (FIG. 7) is placed beneath the section 11 transversely thereof, and raised if necessary by means of blocks C or the like. The beam B should be placed rearwardly of the center of gravity of the section 11, and preferably rearwardly of the wheels W both for greater stability and to keep the wheels W from interfering with placement of the beam B. A similar horizontal support structure is placed beneath the tongue T.

Once the beam B is in place, the traversing assemblies 15 and 16 are placed on the beam B, one traversing assembly being beneath the I-beam 52 and one under the I-beam 54. It is contemplated that the slave traversing assembly 15 will be placed under the I-beam 54, or the support closer to the fixed trailer 10, to prevent having to manipulate a traversable jack assembly in this difficult location. The traversing assemblies 15 and 16 will be so placed that each will have one end under their respective I-beams 52 and 54, and the opposite end will be in the direction of the location to which the structure is to be moved. The traversing assembly 18 is placed upon its temporary horizontal support with one end beneath the vertical jack screw 50 and its other end extending in the direction in which the movable section of the mobile home is to be moved.

Since the space beneath the trailer 11 is usually small, the easiest way to place the traversing assembly beneath the movable section of the mobile home is to place the pan member 20 first, then add the bearing 25 to the pan member, then place the platform 29 on the bearing. This procedure will allow handling only small, relatively light-weight pieces in the confined space.

With the traversing assemblies 15 and 16 in place, jacks J and K (FIG. 7) are placed on the platforms 29*a* and 29*b*, and the jacks J and K are raised to contact the I-beams 52 and 54. At the front of the movable section 11, jack screw 50 is placed in the cup 34*c*, and the crank 51 is rotated to maintain the desired level. The towing vehicle is removed from the movable section 11. The entire trailer 11 is now supported at three points, and there is a jack at each of these three points. By manipulation of the three jacks the entire movable section 11 can be raised to the height of the stationary section 10 and adjusted to be level in all directions.

Next, by appropriate rotation of the travel screws 30*b* and 30*c* of the two master traversable jack assemblies 16 and 18 the platforms 29*b* and 29*c*, along with their jacks K and 50, will be moved along the pan members 20*b* and 20*c*. Since the platform 29*a* is free to move along the pan 20*a*, it also will be moved by following the motion of the two master assemblies. The movement of section 11 is continued until the edges 12 and 14 of the sections 10 and 11 are contiguous. As movable section 11 approaches stationary section 10, and if it is discovered that the two sections are not going to be properly aligned longitudinally, the jacks J, K and 50 can be lowered and disengaged, the pan members 20*a*, 20*b* and 20*c* pivoted as necessary, and the jacks raised again. Continued motion of the travel screws 30*b* and 30*c* should then align the movable section 11 with the stationary section 10.

It will therefore be seen that the present invention provides a very simple and efficient method to assemble two or more structures, and the traversing assemblies in conjunction with the various jacks provide the apparatus to carry out this method. The particular method and apparatus here shown and described are by way of illustration only, and do not restrict the scope of the invention as defined by the appended claims.

I claim:

1. A sectional traversing assembly for a jack comprising an approximately rectangular pan member including a bottom wall with a generally flat upwardly facing surface, side walls extending upwardly from said bottom wall, and end walls, a ladder bearing including a frame and a plurality of needle bearings connected at their ends to said frame, said ladder bearing being shorter than said pan member and freely movable along the length of said pan member between said end walls with its needle bearings in rolling engagement with the bottom wall of said pan member and confined in said pan member by the side walls and end walls of said pan member, a jack platform positioned on the needle bearings of said ladder bearing and movable with respect to said ladder bearing a distance approximately equal to the distance of movement of said ladder bearing along said pan member as the ladder bearing moves along said pan member, an externally threaded travel screw, an internally threaded nut member engaging said travel screw and carried by said jack platform, said travel screw being connectable at its ends to the end walls of said pan member, whereby the pan member can be positioned under an object to be moved, the ladder bearing placed in the pan, the jack platform placed on the needle bearings of the ladder bearing with the ends of the travel screw extending from the jack platform and connected to the end walls of the pan and a jack positioned on the platform and the travel screw rotated to move the jack platform and jack along the length of the pan member with the ladder bearing moving along the pan member beneath the jack platform at approximately one-half the rate of movement of the jack platform.

2. The sectional traversing assembly of claim 1 and wherein said end walls each define an upwardly facing slot and said travel screw is connectable at its ends to said slots.

3. The sectional traversing assembly of claim 1 and wherein said jack platform includes a lower plate of a width less than the space between said side walls and positionable between the side walls of said pan member and on the needle bearings of said ladder bearing and an upper plate of a width greater than the space between said side walls and extendable over the side walls of said pan member.

4. The sectional traversing assembly of claim 1 and wherein said bottom wall of said pan extends beyond said end walls.

* * * * *